US008201710B2

(12) United States Patent
Helf et al.

(10) Patent No.: US 8,201,710 B2
(45) Date of Patent: Jun. 19, 2012

(54) ATTACHMENT MECHANISM FOR A DISPENSER

(75) Inventors: Thomas A. Helf, New Berlin, WI (US); Murthy S. Munagavalasa, Racine, WI (US); Edward L. Paas, Los Altos, CA (US)

(73) Assignee: S.C. Johnson & Son, Inc., Racine, WI (US)

( * ) Notice: Subject to any disclaimer, the term of this patent is extended or adjusted under 35 U.S.C. 154(b) by 897 days.

(21) Appl. No.: 12/287,910

(22) Filed: Oct. 15, 2008

(65) Prior Publication Data

US 2010/0089950 A1 Apr. 15, 2010

(51) Int. Cl.
*B67B 1/00* (2006.01)

(52) U.S. Cl. ..... 222/153.09; 222/402.13; 29/428

(58) Field of Classification Search ..... 222/153.09, 222/153.11–153.14, 402.1, 402.11, 402.13, 222/644, 52, 1, 402.14, 402.21; 29/428
See application file for complete search history.

(56) References Cited

U.S. PATENT DOCUMENTS

| | | | |
|---|---|---|---|
| 2,173,610 | A | 9/1939 | Haven |
| 2,961,128 | A | 11/1960 | Cochran |
| 3,013,700 | A | 12/1961 | Steinkamp |
| 3,149,757 | A | 9/1964 | Safianoff |
| 3,180,532 | A | 4/1965 | Michel |
| 3,187,949 | A | 6/1965 | Mangel |
| 3,273,610 | A | 9/1966 | Frost |
| 3,329,314 | A | 7/1967 | Kolodziej |
| 3,351,240 | A | 11/1967 | Gray |
| 3,497,110 | A | 2/1970 | Bombero et al. |
| 3,591,058 | A | 7/1971 | Johnston |
| 3,666,144 | A | 5/1972 | Winder |
| 3,690,519 | A | 9/1972 | Wassilieff |
| 3,706,401 | A | 12/1972 | Gach |
| 3,721,423 | A | 3/1973 | Shay |
| 3,764,044 | A | 10/1973 | Pajak |
| 3,768,707 | A | 10/1973 | Nigro |
| 3,819,090 | A | 6/1974 | Birrell |
| 3,885,712 | A | 5/1975 | Libit |
| 3,901,412 | A | 8/1975 | Copia |
| 3,915,348 | A | 10/1975 | Suhr |
| 4,133,448 | A | 1/1979 | Balfanz |
| 4,993,570 | A | 2/1991 | Julian et al. |

(Continued)

FOREIGN PATENT DOCUMENTS

WO WO 2006/087516 8/2006

(Continued)

OTHER PUBLICATIONS

International Search Report in PCT/US2008/009664 dated Dec. 4, 2008.

(Continued)

*Primary Examiner* — Kevin P Shaver
*Assistant Examiner* — Donnell Long

(57) ABSTRACT

An attachment mechanism for a container includes a bracket and a connector. The bracket has upper and lower portions. An annular wall is disposed between the upper and lower portions. A plurality of projections extend from the lower portion. The projections are adapted to releasably engage an upper portion of a container. A tab extends radially inwardly from the upper portion. The connector has a prong, wherein a distal portion of the prong is spaced circumferentially from the connector. The prong is adapted to be secured within a slot defined between the tab and the annular wall.

20 Claims, 10 Drawing Sheets

U.S. PATENT DOCUMENTS

| | | | | |
|---|---|---|---|---|
| 5,213,223 | A | 5/1993 | Minnette | |
| 5,489,047 | A | 2/1996 | Winder | |
| 5,509,438 | A | 4/1996 | Leonard et al. | |
| 5,549,228 | A | 8/1996 | Brown | |
| 5,741,003 | A | 4/1998 | Segien, Jr. | |
| 5,868,126 | A | 2/1999 | Long et al. | |
| 5,915,595 | A | 6/1999 | Dow et al. | |
| 5,927,313 | A | 7/1999 | Hart | |
| 6,216,925 | B1 | 4/2001 | Garon | |
| 6,283,332 | B1 | 9/2001 | Ragno | |
| 6,296,156 | B1 | 10/2001 | Lasserre et al. | |
| 6,321,742 | B1 | 11/2001 | Schmidt et al. | |
| 6,338,424 | B2 | 1/2002 | Nakamura et al. | |
| 6,405,768 | B1 | 6/2002 | McClaran | |
| 6,439,259 | B1 | 8/2002 | Beaver | |
| 6,758,373 | B2 | 7/2004 | Jackson et al. | |
| 6,877,643 | B2 | 4/2005 | Schneider | |
| 6,918,512 | B2 | 7/2005 | Kondoh | |
| 6,971,560 | B1 * | 12/2005 | Healy et al. | 222/645 |
| 6,974,091 | B2 | 12/2005 | McLisky | |
| 6,978,914 | B2 * | 12/2005 | Furner et al. | 222/402.1 |
| 7,044,337 | B1 | 5/2006 | Kou | |
| 7,066,442 | B2 | 6/2006 | Rose | |
| 7,097,058 | B2 * | 8/2006 | Wellman et al. | 215/330 |
| 7,434,594 | B1 | 10/2008 | Robbins et al. | |
| 7,487,891 | B2 | 2/2009 | Yerby et al. | |
| 7,530,476 | B2 * | 5/2009 | Downey et al. | 222/153.11 |
| 7,611,032 | B2 | 11/2009 | Brunerie et al. | |
| 7,699,190 | B2 | 4/2010 | Hygema | |
| 7,819,288 | B2 * | 10/2010 | Healy et al. | 222/162 |
| 7,837,065 | B2 * | 11/2010 | Furner et al. | 222/52 |
| 7,938,340 | B2 * | 5/2011 | Anderson et al. | 239/337 |
| 7,938,342 | B2 | 5/2011 | Octeau et al. | |
| 7,959,022 | B2 | 6/2011 | Kerman et al. | |
| RE42,553 | E * | 7/2011 | de Pous et al. | 222/153.09 |
| 8,033,429 | B2 * | 10/2011 | Keller | 222/145.6 |
| 8,038,026 | B2 * | 10/2011 | Auer et al. | 220/326 |
| 2004/0011885 | A1 | 1/2004 | McLisky | |
| 2006/0289679 | A1 | 12/2006 | Johnson | |
| 2007/0199952 | A1 | 8/2007 | Carpenter et al. | |
| 2008/0053949 | A1 | 3/2008 | Farrar et al. | |
| 2009/0014679 | A1 | 1/2009 | Hygema et al. | |
| 2010/0025437 | A1 | 2/2010 | Oshimo et al. | |

FOREIGN PATENT DOCUMENTS

| | | |
|---|---|---|
| WO | WO 2008/115391 | 9/2008 |

OTHER PUBLICATIONS

International Search Report and Written Opinion dated Jan. 20, 2010 Appl. No. PCT/US2009/005626.

* cited by examiner

ATTACHMENT MECHANISM FOR A DISPENSER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present disclosure relates generally to an attachment mechanism for a container, and more particularly to an attachment mechanism for securing an actuator cap to an aerosol container.

2. Description of the Background of the Invention

Discharge devices for automatically dispensing a pressurized fluid may be placed on containers to dispense fluid in response to a signal or manual actuation. However, a typical problem with prior art discharge devices is the inability to prevent the use of a specific discharge device with an incompatible container. Such a combination may result in damage to the discharge device or container, complete or partial inoperability of the discharge device, or improper actuation of the container. Further, in some instances it is preferred that a certain discharge device only be used in conjunction with a particular fluid to be dispensed from a specific container. The present invention provides for a novel attachment mechanism for a discharge device to ensure that the discharge device is secured to an appropriate container. Further, the present invention also provides for a novel means of securing a discharge device on a container to ensure appropriate activation of the discharge device and/or container when in an operative state. Other advantages and benefits of the above noted attachment mechanism will be apparent from reading the description provided below.

SUMMARY OF THE INVENTION

According to one embodiment, an attachment mechanism for a container includes a bracket and a connector. The bracket has upper and lower portions, wherein an annular wall is disposed between the upper and lower portions. A plurality of projections extend from the lower portion, wherein the projections are adapted to releasably engage an upper portion of a container. A tab extends radially inwardly from the upper portion. The connector has a prong, wherein a distal portion of the prong is spaced circumferentially from the connector, and wherein the prong is adapted to be secured within a slot defined between the tab and the annular wall.

According to another embodiment, a dispensing system includes a bracket having upper and lower portions, wherein an annular wall is disposed between the upper and lower portions. A plurality of projections extend from the lower portion, wherein the projections are adapted to releasably engage an upper portion of a container. A plurality of tabs extend radially inwardly from the upper portion. An actuator cap includes a connector with a plurality of prongs, wherein a distal portion of the plurality of prongs is spaced circumferentially from the connector. The plurality of prongs are adapted to be secured within a slot defined between the plurality of tabs and the annular wall. A guiding sleeve extends downwardly from the actuator cap, wherein the guiding sleeve has a shape that is complementary to a shape of the bracket and is adapted to align the actuator cap with the bracket.

According to yet another embodiment, a method of attaching a cap to a container includes the step of providing a bracket. The bracket has upper and lower portions, wherein an annular wall is disposed between the upper and lower portions. The method further includes the steps of providing a plurality of projections that extend from the lower portion, wherein the projections are adapted to releasably engage an upper portion of a container, and providing a tab extending radially inwardly from the upper portion. Still further, the method includes the step of providing a connector having a prong, wherein a distal portion of the prong is spaced circumferentially from the connector and wherein the prong is adapted to be secured within a slot defined between the tab and the annular wall.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
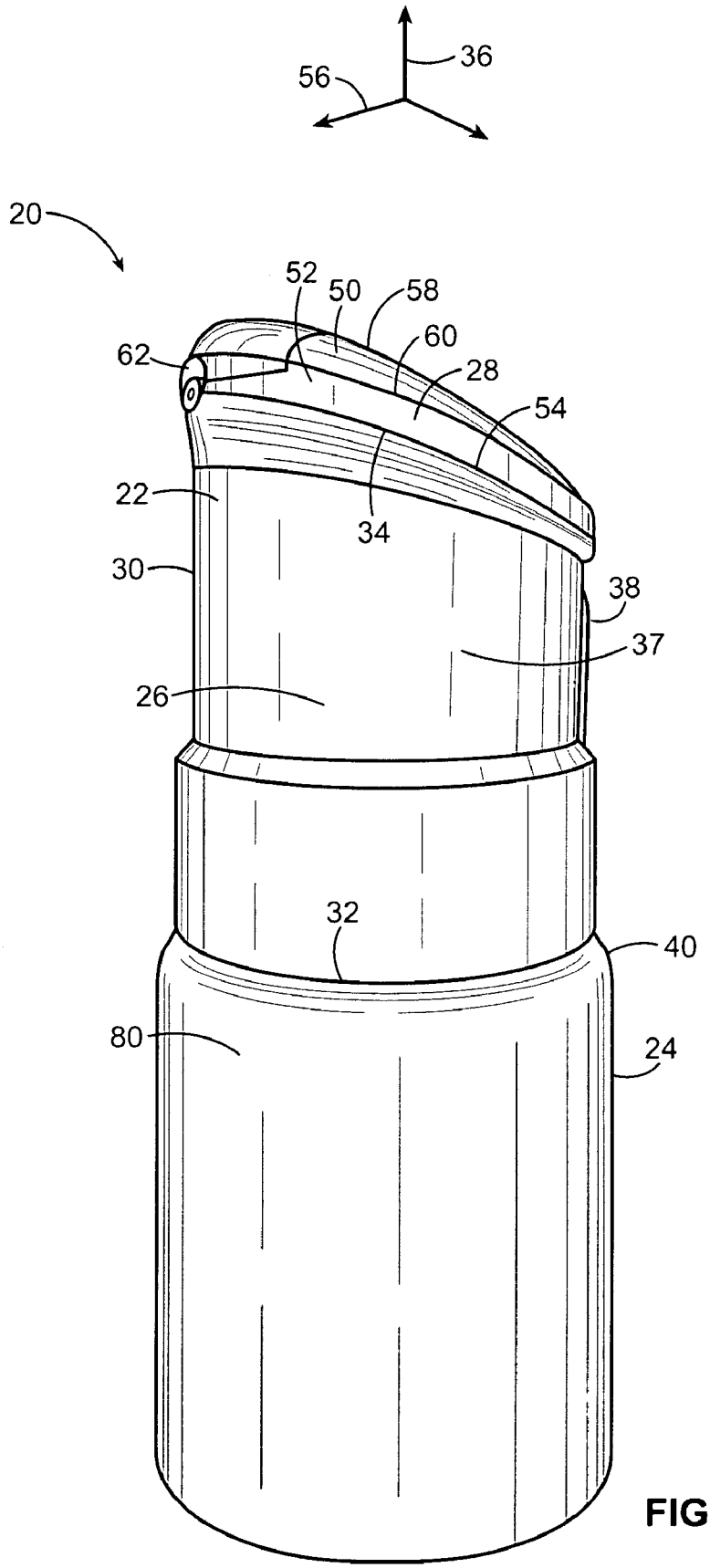
FIG. 1 is a front isometric view of one embodiment of a fluid dispensing system.
Figure 2:
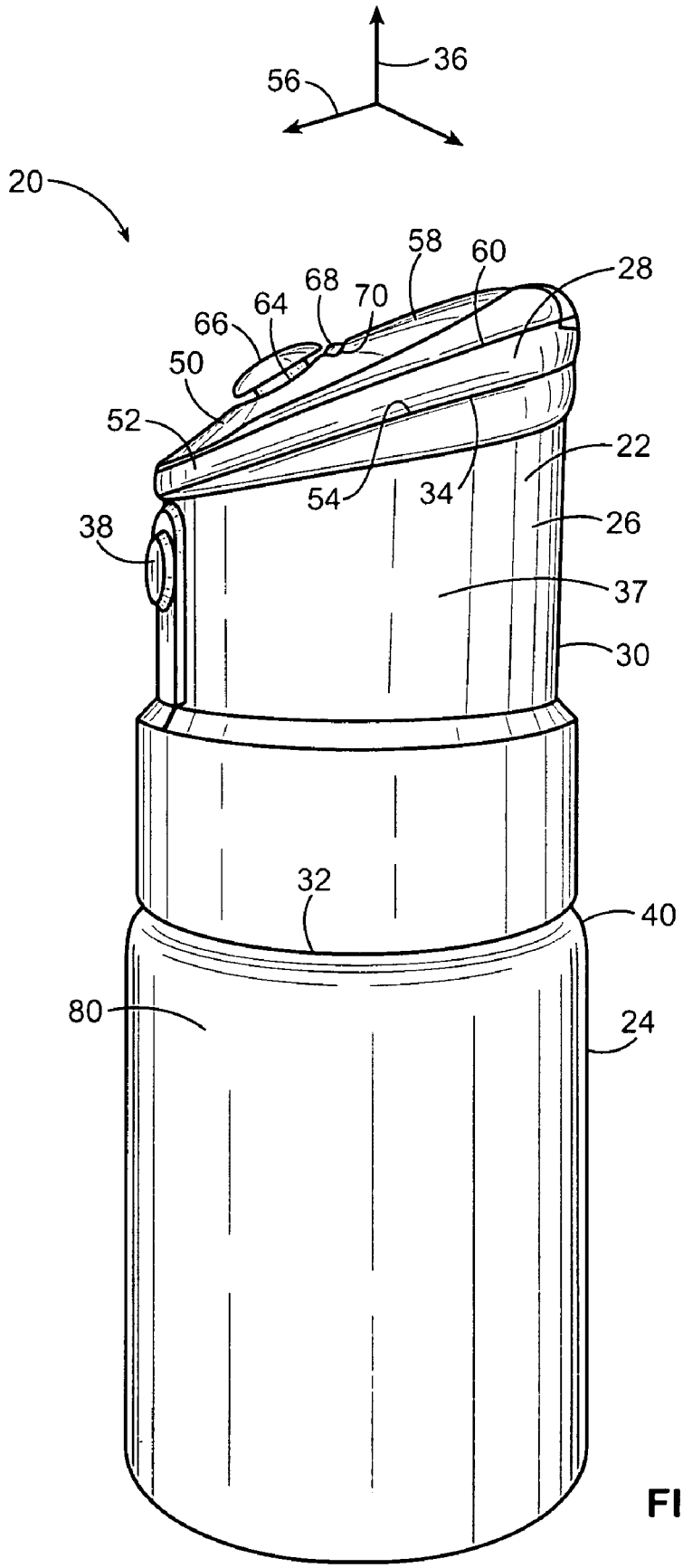
FIG. 2 is a rear isometric view of the fluid dispensing system of FIG. 1.
Figure 3:
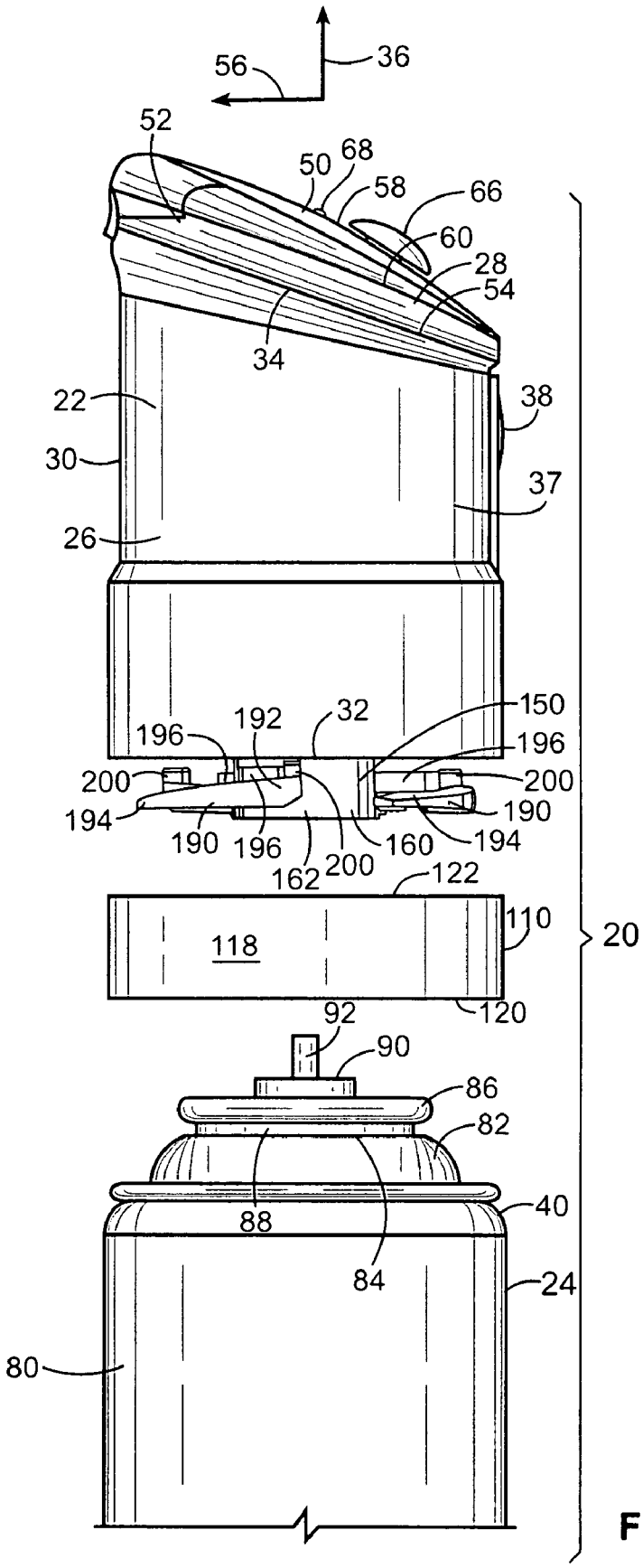
FIG. 3 is an exploded front elevational view of the fluid dispensing system of FIG. 1 which includes a container, a bracket, and an actuator cap with a connector.

FIGS. 1-3 depict a fluid dispensing system 20 that includes an actuator cap 22 mounted on an aerosol container 24. The actuator cap 22 discharges fluid from the container 24 upon the occurrence of a particular condition. The condition could be the manual activation of the actuator cap 22 or the automatic activation of the actuator cap 22 in response to an electrical signal generated by a timer or a sensor. The fluid discharged may be a fragrance or insecticide disposed within a carrier liquid, a deodorizing liquid, or the like. The fluid may also comprise other actives, such as sanitizers, air fresheners, odor eliminators, mold or mildew inhibitors, insect repellents, and/or the like, and/or that have aromatherapeutic properties. The fluid alternatively comprises any fluid known to those skilled in the art that may be dispensed from the container 24. The container 24 is therefore adapted to dispense any number of different fluid formulations.

The actuator cap 22 includes a body portion 26 and a cap portion 28 disposed on a top end thereof. The body portion 26 includes a sidewall 30 and is adapted to be gripped by a user's hand. The sidewall 30 extends from a lower end 32 of the body portion 26 to an upper end 34 thereof. The sidewall 30 tapers inwardly about a longitudinal axis 36 of the actuator cap 22 so that a cross-sectional diameter of the lower end 32 and the upper end 34 is larger than a cross-sectional diameter of a medial portion 37. A manually depressible switch 38 is also provided on the body portion 26 to allow a user to activate the actuator cap 22. As will be described in further detail below, the lower end 32 of the body portion 26 is adapted to be securely retained on an upper end 40 of the aerosol container 24.

The cap portion 28 comprises a shell 50 and an annular rim 52. A lower end 54 of the annular rim 52 is disposed on the upper end 34 of the sidewall 30 and truncates same at approximately a 45 degree angle relative to a transverse axis 56 of the actuator cap 22. The shell 50 extends from the annular rim 52 to an upper generally convex surface 58. The convex surface 58 of the shell 50 is bounded by an elliptical shaped edge 60 that extends circumferentially around the convex surface 58. A discharge orifice 62 is provided on the rim 52 at a front end thereof for the discharge of fluid through the actuator cap 22. In addition, a first opening 64 is provided on the convex surface 58 of the shell 50. A toggle switch 66 extends through the opening 64 to enable a user to activate the actuator cap 22. The toggle switch 66 is operatively coupled to a control circuit (not shown) that is disposed within the actuator cap 22. The switch 66 enables a user to select one of several dispensing schemes that may be implemented by the control circuit. A light emitting diode (LED) 68 protrudes through a second opening 70 that is provided on the convex surface 58 of the shell 50. The LED 68 illuminates to provide visual indication to the user when the control circuit is activated. In other embodiments, any of the actuator caps described in U.S. patent application Ser. Nos. 11/801,554, 11/805,976, 11/893,456, 11/893,476, 11/893,489, and 11/893,532, which are herein incorporated by reference in their entirety, may be utilized.

As shown in FIG. 3, the container 24 may be an aerosol container of any size and volume known to those skilled in the art. However, the container 24 preferably comprises a body 80 with a mounting cup 82 crimped to the upper end 40 thereof. The mounting cup 82 is generally cylindrical in shape and includes an outer wall 84 that extends circumferentially therearound. A neck 86 extends from the outer wall 84 and forms an undercut 88 therebetween. A pedestal 90 extends upwardly from a central portion of the mounting cup 82. A valve assembly (not shown) within the container 24 includes a valve stem 92 that extends upwardly through the pedestal 90. The valve stem 92 may be a tilt valve stem or an axially depressible valve stem known to one of skill in the art. When a distal end of the valve stem 92 is depressed by a sufficient force along a longitudinal axis of the container 24, i.e., into an operable position, the valve assembly is opened and the contents of the container 24 are discharged through a discharge orifice or end 94 in the valve stem 92 (see FIGS. 4 and 11). The contents of the container 24 may be discharged in a continuous or metered dose. Further, the discharging of the contents of the container 24 may be effected in any number of ways, e.g., a discharge may comprise a partial metered dose or multiple consecutive discharges.

FIGS. 3-6 illustrate a bracket 110, which in the present embodiment has a generally ring-like appearance. However, in other embodiments the bracket 110 may comprise any other geometric shape. The bracket 110 has an annular wall 112 that demarcates the bracket 110 into an upper portion 114 and a lower portion 116. The bracket 110 further includes an outer wall 118 that extends between a bottom end 120 and a top end 122. Further, a plurality of equidistantly spaced radially inwardly projecting tabs 124 are provided adjacent the top end 122 of the bracket 110. In other embodiments, a single tab or a different number of spaced inwardly projecting tabs 124 are provided adjacent the top end 122. The inwardly projecting tabs 124 define a slot 126 between the top end 122 of the bracket 110 and the annular wall 112.

Figure 4:
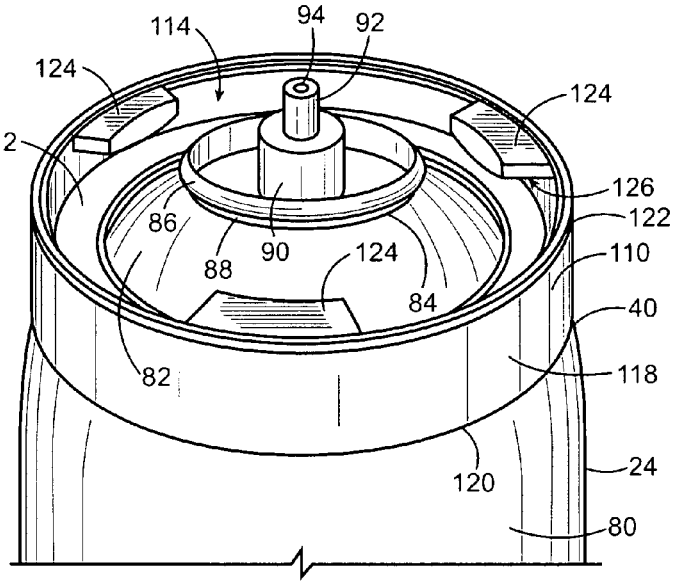
FIG. 4 is an isometric view of the fluid dispensing system of FIG. 1 with portions removed to show a container and a bracket.
Figure 5:
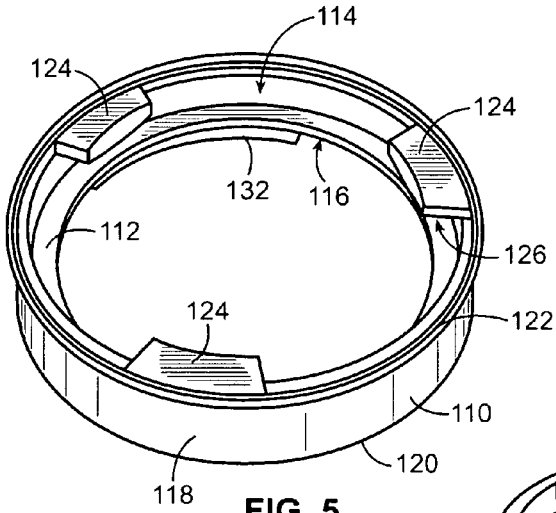
FIG. 5 is an isometric view of the bracket of FIGS. 3 and 4.
Figure 6:
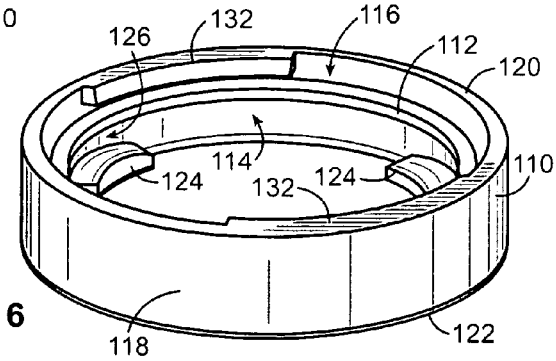
FIG. 6 is a bottom isometric view of the bracket of FIG. 5.
Figure 7:
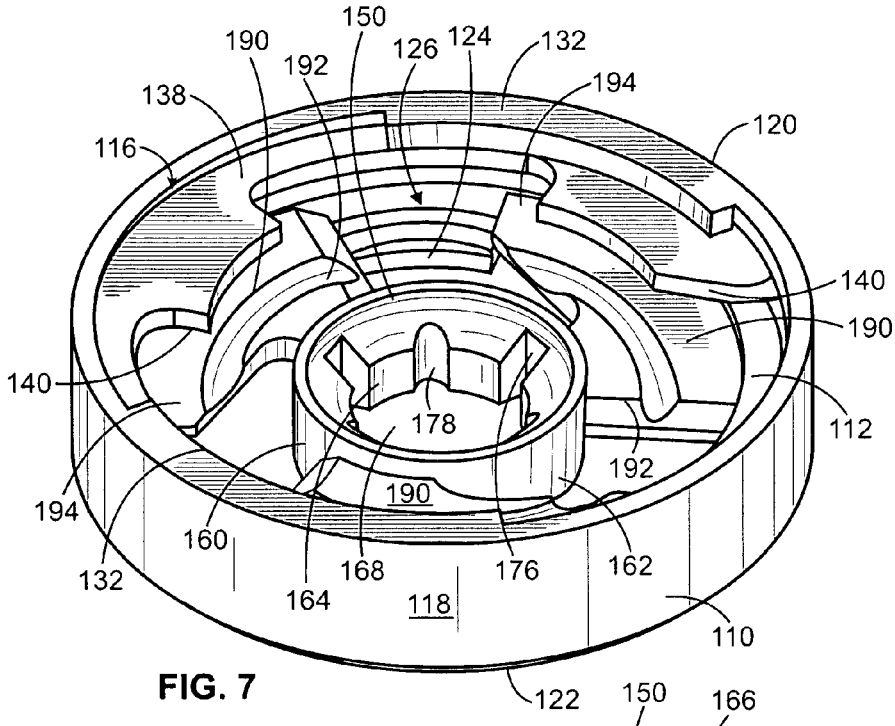
FIG. 7 is view similar to the one shown in FIG. 6 except that the connector shown in FIG. 3 is provided to illustrate the interconnection between the connector and the bracket.

As shown in FIG. 6, the lower portion 116 includes two spaced flanges 132 that extend radially inwardly adjacent the bottom end 120 of the bracket 110. The lower portion 116 further includes a shaped locking element 138 (see FIG. 7). In one embodiment, the shaped locking element 138 is integral with the bracket 110. In the present embodiment, the shaped locking element 138 is secured within the lower portion 116 of the bracket 110 by a friction fit between the annular wall 112 and the spaced flanges 132. As depicted in FIG. 7, the locking element 138 includes two inwardly projecting members 140. The members 140 are adapted to retain the bracket 110 on the container 24 by an interference fit between the members 140 and surfaces of the container 24 that define the undercut 88. Therefore, the shaped locking element 138 and the bracket 110 are both securely attached to the upper end 40 of the container 24 as depicted in FIG. 4. In an alternative embodiment, it is contemplated that one or more of the projecting members 140 may extend from the bracket 110 in combination with, or in lieu of, the projecting members 140 extending from the locking element 138.

Figure 8:
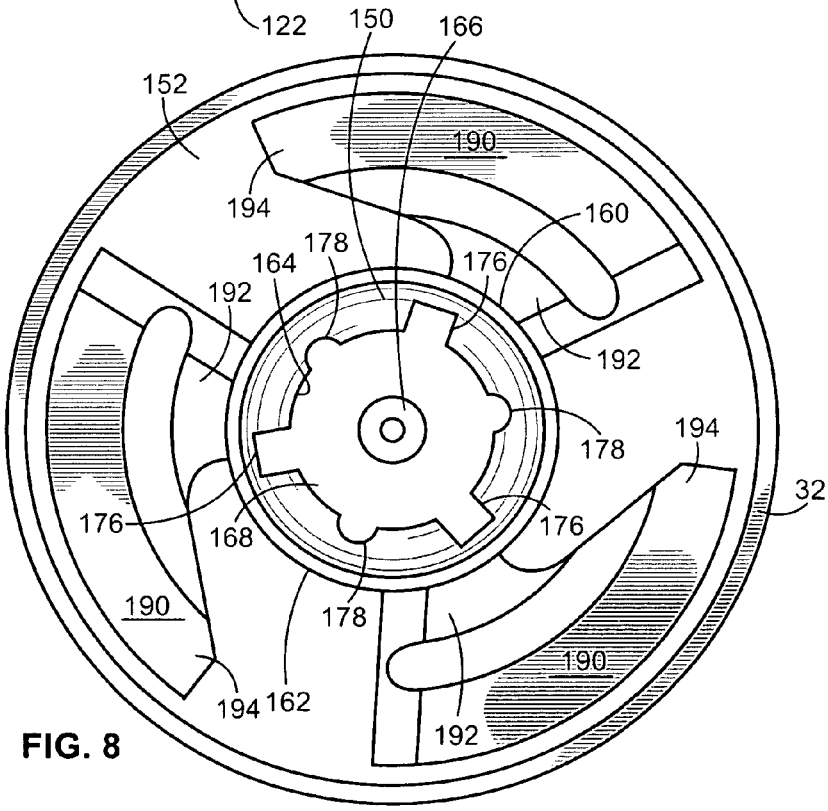
FIG. 8 is a bottom elevational view of the actuator cap of FIG. 3 showing the connector attached thereto in greater detail.

Turning to FIG. 8, a connector 150 is shown depending from a disc 152. The disc 152 is attached to a bottom portion of the actuator cap 22 by, for example, screws or other attachment means (not shown). The connector 150 is similarly attached to the disc 152 by any means known to those skilled in the art, e.g., the connector 150 can be mechanically or adhesively secured to the disc 152. Alternatively, the connector 150 may be provided integrally with the bottom portion of the actuator cap 22.

Figure 9:
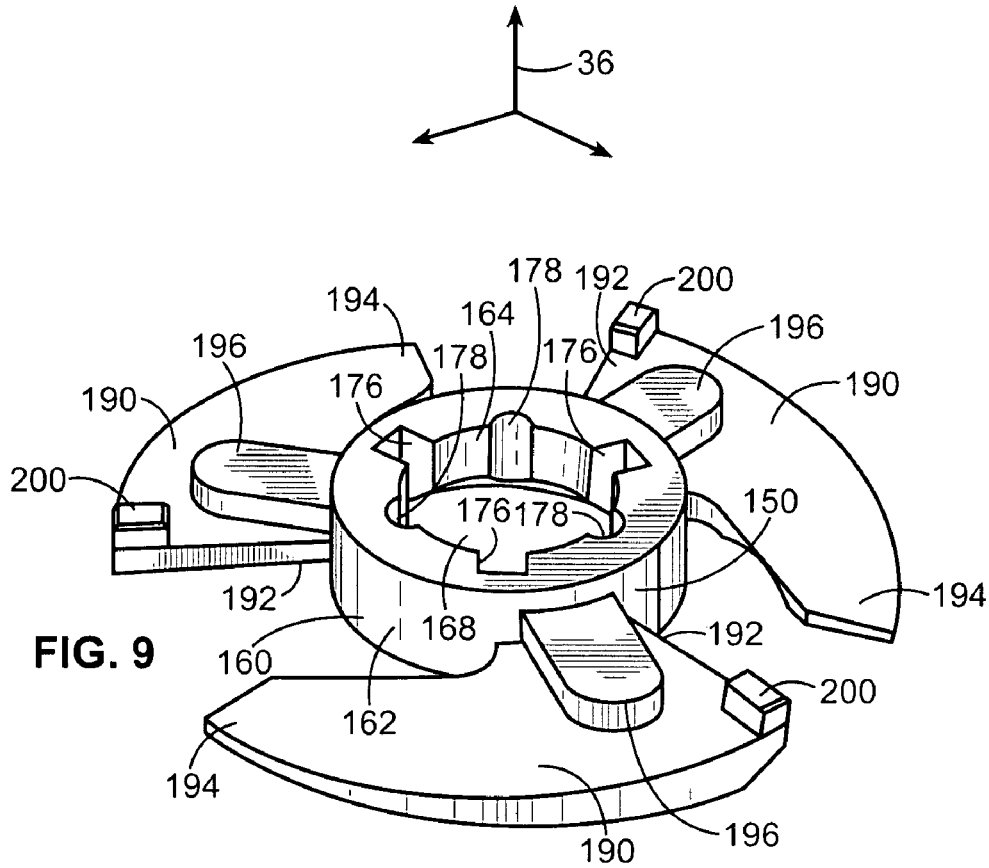
FIG. 9 is a top isometric view of the connector removed from the actuator cap depicted in FIG. 8.
Figure 10:
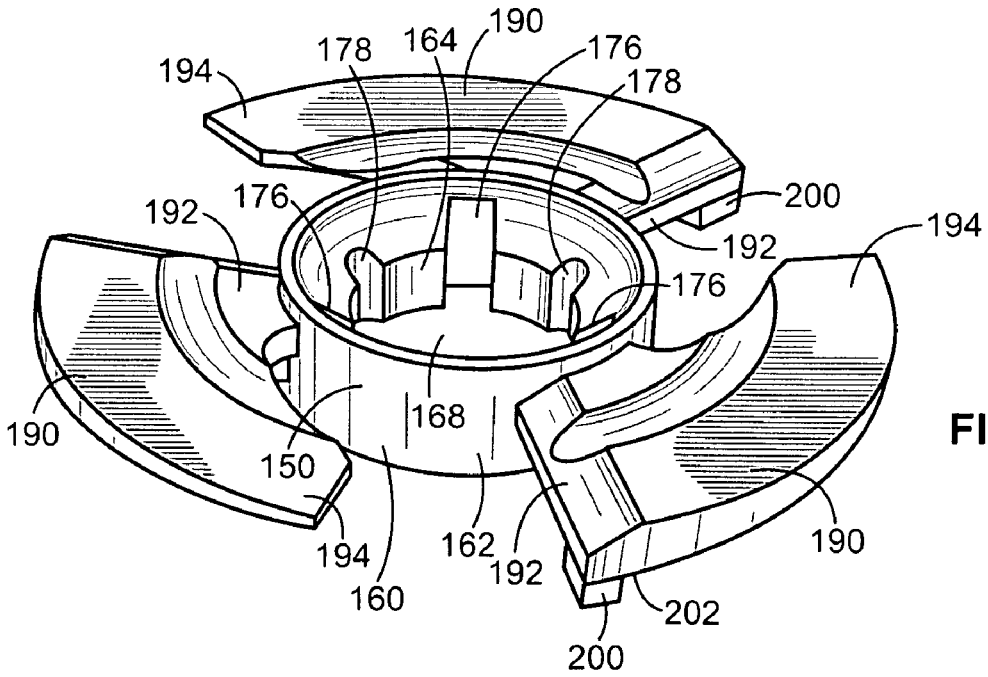
FIG. 10 is a bottom isometric view of the connector of FIG. 9.
Figure 11:
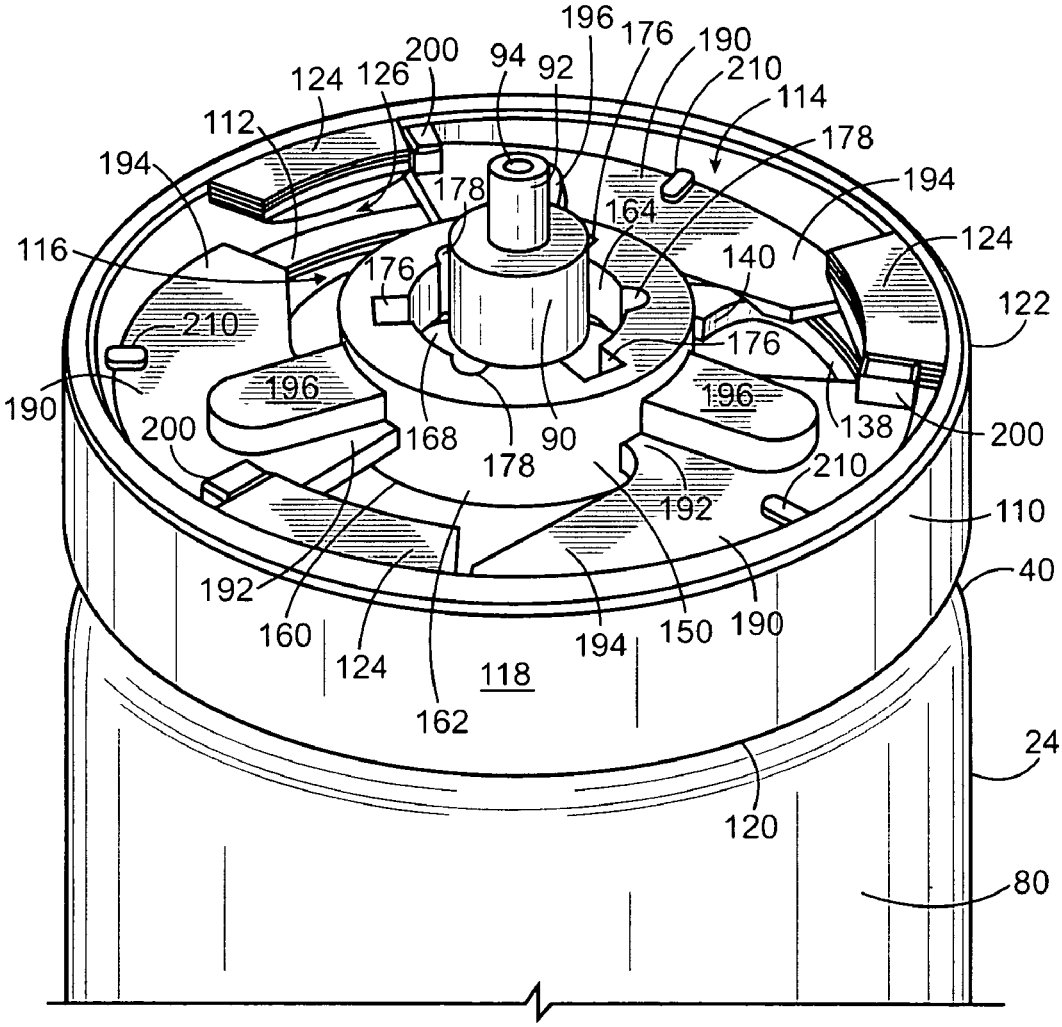
FIG. 11 is an isometric view of the fluid dispensing system shown in FIG. 1 with the actuator cap omitted to show a bracket disposed on a container and a connector, wherein the connector is in a first pre-operative position.

The connector 150 is defined by a generally annular member 160 having an outer wall 162 and an inner wall 164 (see FIGS. 7 and 11). Referring to FIG. 8, a conduit 166 is provided that is in fluid communication with the discharge orifice 62 of the actuator cap 22. The conduit 166 extends through the disc 152 and into a central portion 168 of the annular member 160. The central portion 168 is defined by the inner wall 164 of the annular member 160. The inner wall 164 comprises a cylindrical surface truncated by three equidistantly spaced rectangular notches 176. Further, three equidistantly spaced semi-circular grooves 178 are interposed between the rectangular notches 176 on the inner wall 164. The outer wall 162 is defined by a cylindrical surface. Turning to FIGS. 9 and 10, the connector 150 is shown to have three equidistantly spaced sickle-shaped prongs 190 extending outwardly from the outer wall 162. Each prong 190 includes a cradle portion 192 that is directly attached to the outer wall 162 and a tapered blade segment 194 that is spaced from the outer wall 162. In addition, each prong 190 is inclined relative to a transverse axis 56 thereof. A reinforcement member 196 also extends outwardly from the outer wall 162 and upwardly from a top portion of the cradle portion 192. The reinforcement member 196 is provided to enhance the stability of each prong 190. In addition, a finger or flange 200 is provided at an end of each cradle portion 192. It is also contemplated that other embodiments may include varying numbers of prongs 190 or modifications to the prongs 190, e.g., it is envisioned that one prong 190 may be provided or that one or more of the prongs 190 may not include a reinforcement member 196 or a flange 200.

Figure 12:
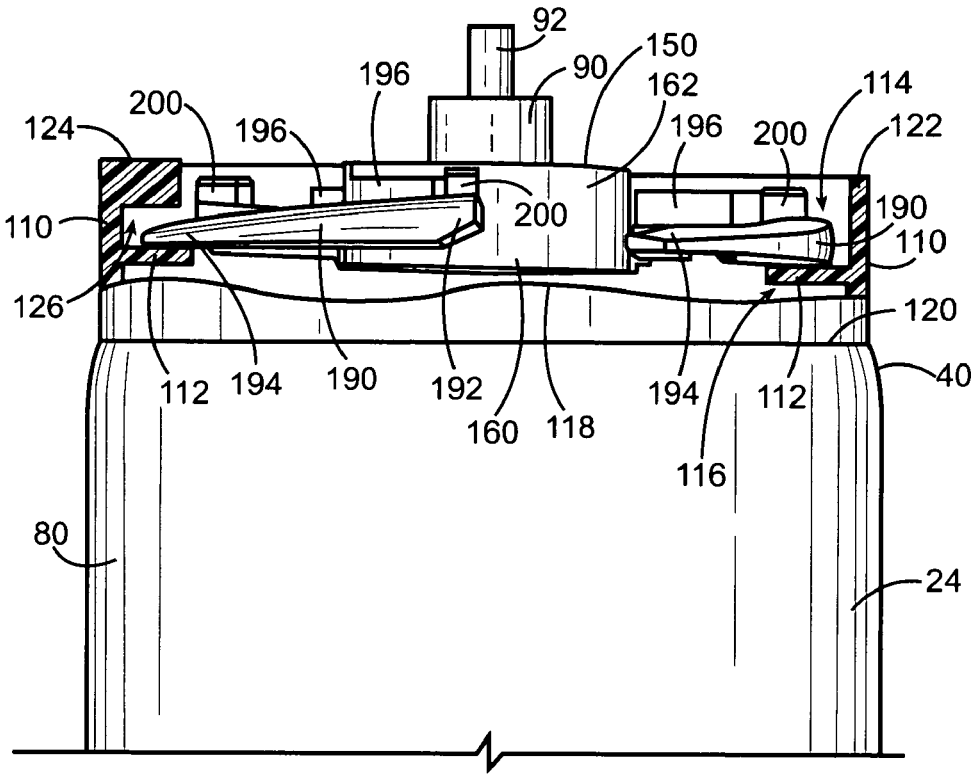
FIG. 12 is a front elevational view of the fluid dispensing system of FIG. 11 showing the bracket and the connector in a second pre-operative position with portions of the bracket removed for purposes of clarity.
Figure 13:
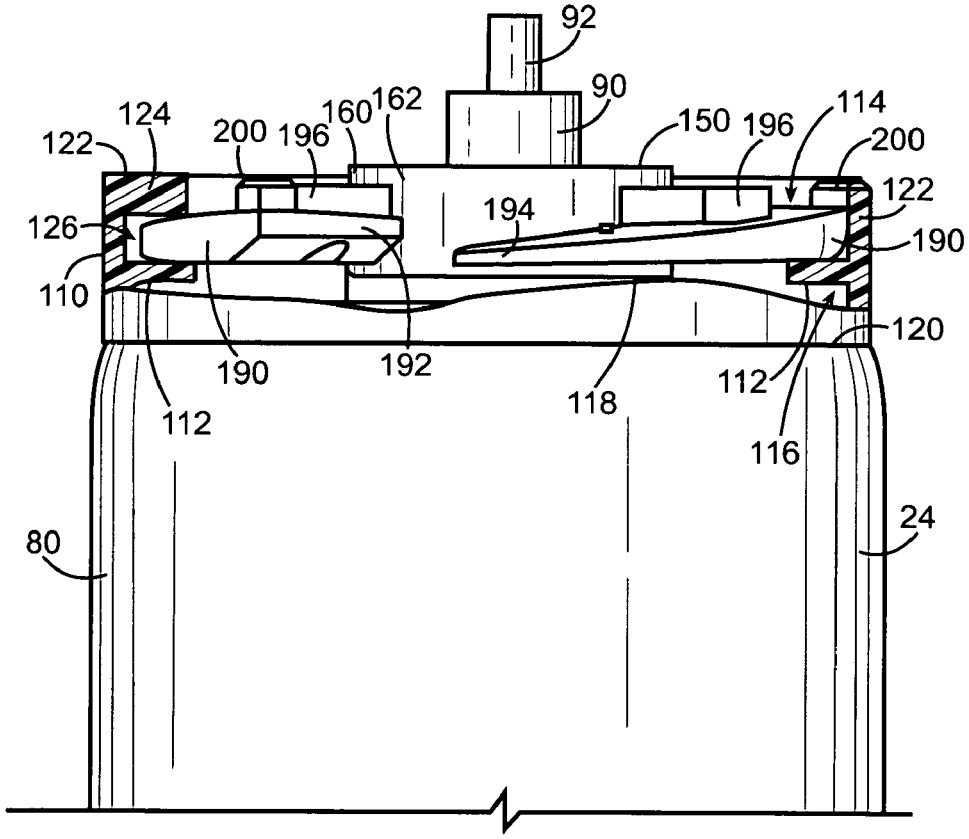
FIG. 13 is a front elevational view of the fluid dispensing system of FIG. 12 showing the bracket and the connector in an operative position.

To illustrate how the actuator cap 22 and the connector 150 transition from a non-use state into an operative state, reference will be had to FIGS. 11-13. With specific reference to FIG. 11, the connector 150 is shown in a non-use state. To transition the connector 150 into the operative state, a user grabs the actuator cap 22 and rotates same in a clockwise direction, which similarly rotates the connector 150 in a clockwise direction. Continued rotational movement of the connector 150 causes the sickle-shaped prongs 190 to be rotated and ramped downwardly into the slot 126 provided between the projecting tabs 124 and the annular wall 112 (see FIG. 12). Further rotation of the connector 150 forces the cradle portion 192 of the sickle-shaped prongs 190 to form a friction fit within the slot 126 between the projecting tabs 124 and the annular wall 112 (see FIG. 13). Upon placing the connector 150 into the operative state, the portions defining the conduit 166 impinge on the valve stem 92 to hold same in an open position, thereby allowing fluid to flow from the container 24 and through the conduit 166. Thereafter, fluid is dispensed through the discharge orifice 62 by an actuation mechanism in response to a signal generated by a manual actuator, a timer, or a sensor. It is contemplated that any of the actuation mechanisms or dispensing methodologies described in U.S. patent application Ser. Nos. 11/801,554, 11/805,976, 11/893,456, 11/893,476, 11/893,489, and 11/893,532, may be utilized in conjunction with the presently described attachment mechanism. It is also contemplated that placement of the actuator cap 22 and the connector 150 in the operative state provides for the partial depression or activation of the valve stem 92 or, alternatively, does not depress or otherwise activate the valve stem 92.

In an alternative embodiment, it is also contemplated that the fluid dispensing system 20 include a mechanism for preventing actuation of the container 24 and the actuator cap 22 during transportation or storage of the fluid dispensing system 20. During an initial non-use state, the sickle-shaped prongs 190 are provided substantially between the projecting tabs 124 in the upper portion 114 of the bracket 110 (see FIG. 11). A plurality of frangible ribs 210 extend inwardly from the upper portion 114 of the bracket 110 and are connected to portions of one or more of the prongs 190. The frangible ribs 210 prevent substantial rotation of the connector 150. To place the fluid dispensing system 20 in an operable position, a user rotates the actuator cap 22 with a sufficient amount of force to break the one or more frangible ribs 210 and rotate the connector 150 into the operative position.

Figure 14:
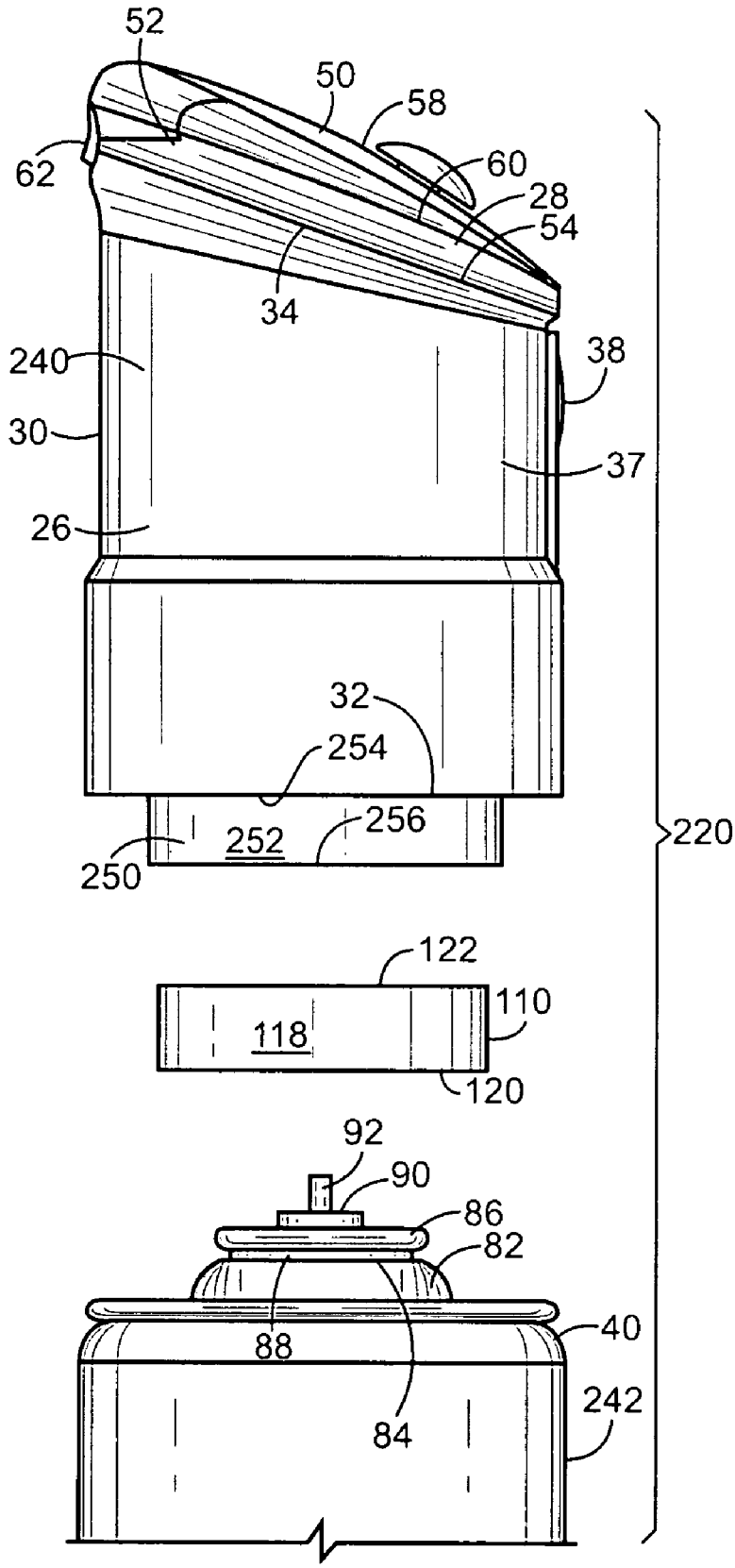
FIG. 14 is an exploded front elevational view of another embodiment of the fluid dispensing system of FIG. 1, which depicts a container, a bracket, and an actuator cap with an alignment guide.
Figure 15:
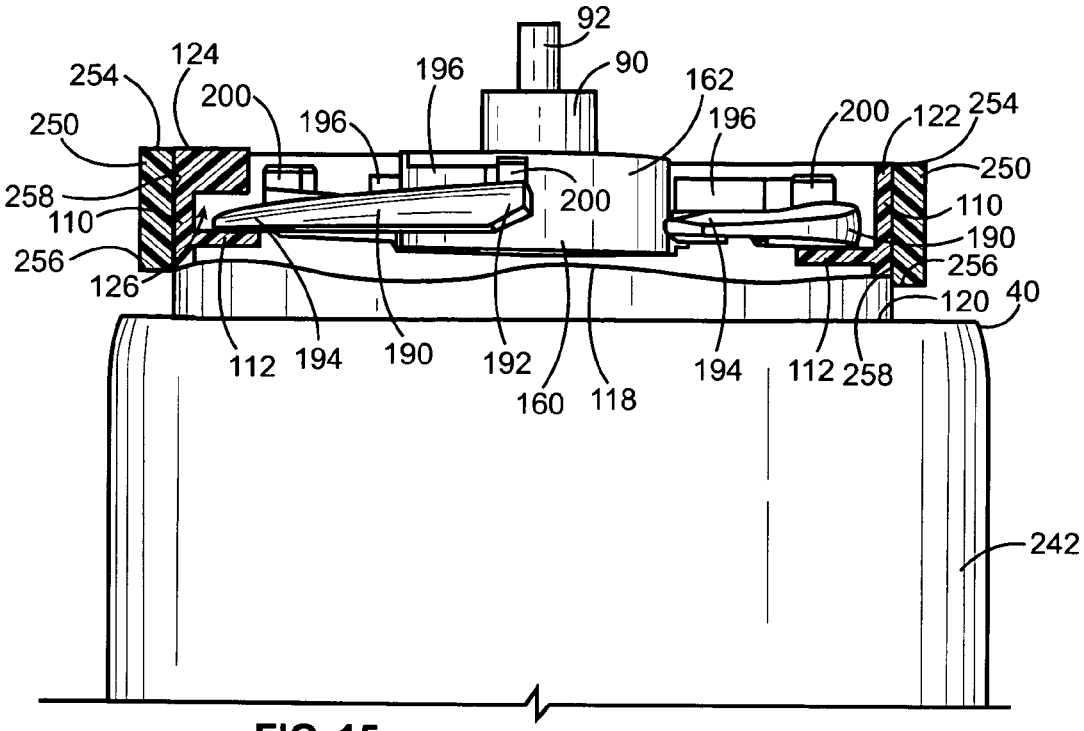
FIG. 15 is a front elevational view of the fluid dispensing system of FIG. 14 with the actuator cap omitted to show the bracket disposed on the container and a connector, wherein portions of the bracket and the alignment guide have been removed for purposes of clarity to better illustrate the connector in a pre-operative position.
Figure 16:
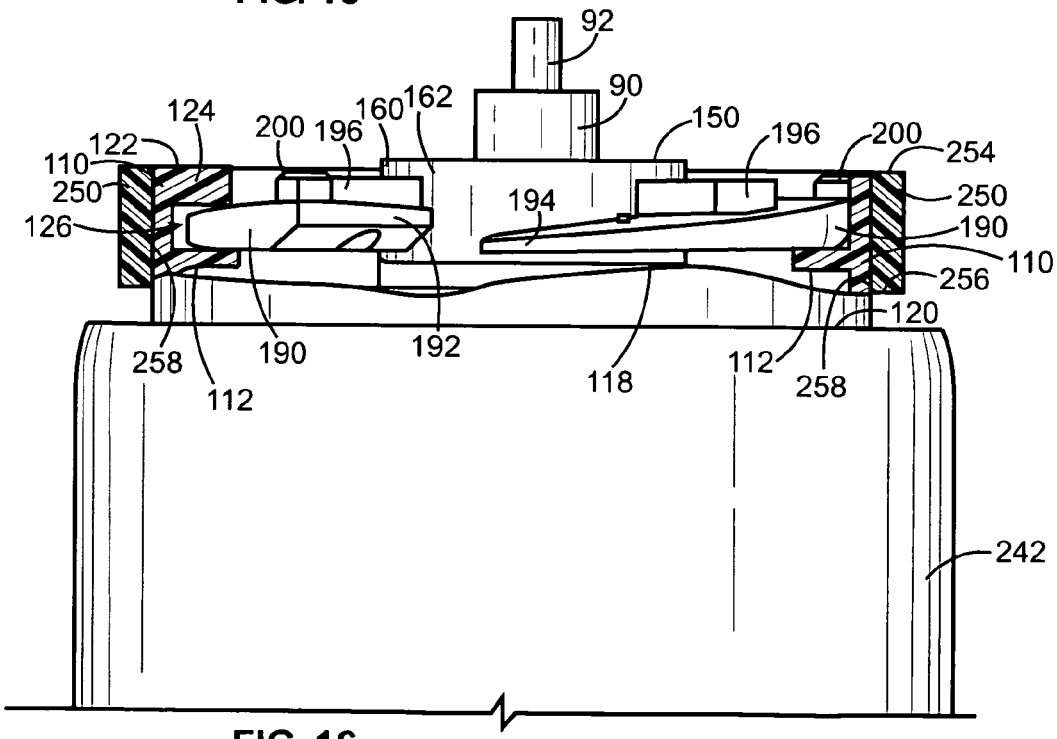
FIG. 16 is a front elevational view of the fluid dispensing system of FIG. 15 showing the alignment guide and the connector in an operative position.

Referring to FIGS. 14-16, yet another embodiment of a fluid dispensing system 220 is shown, which is similar to the fluid dispensing system 20 described above. The fluid dispensing system 220 includes an actuator cap 240 that is identical to the actuator cap 22 except that the actuator cap 240 has a larger outer diameter at the lower end 32 thereof. Further, the actuator cap 240 is adapted to be mounted on an aerosol container 242 that has a larger outer diameter than the aerosol container 24. However, it is envisioned that the present embodiment may be modified to work with any size container or actuator cap, including those described hereinabove. A guiding sleeve 250, which in the present embodiment has a generally ring-like appearance, depends from the disc 152 (see FIG. 8) to enable a user to align the actuator cap 240 with the bracket 110 that is disposed on the aerosol container 242. It is contemplated that the guiding sleeve 250 may comprise any other geometric shape that is complementary to the shape of the bracket 110 in other embodiments. The guiding sleeve 250 has a wall 252 that extends between an upper end 254 and a lower end 256 thereof. As shown in FIGS. 15 and 16, the guiding sleeve 250 is dimensioned to have an inner diameter that is slightly larger than the outer diameter of the bracket 110. When a user attaches the actuator cap 240 to the aerosol container 242, an interior wall 258 of the guiding sleeve 250 is secured around the bracket 110 by friction fit, thereby preventing misalignment of the actuator cap 240 with the container 242.

The guiding sleeve 250 of the present embodiment provides several advantages over other dispensing systems, such as the ability to allow a user to rely on physical or tactile forces to assist in aligning the actuator cap 240 with the aerosol container 242 as opposed to relying solely on visual alignment. For example, a user can quickly attach the actuator cap 240 to the aerosol container 242 by responding to the resistive forces exerted on the actuator cap 240 by way of interaction between the guiding sleeve 250 and the bracket 110 when the actuator cap 240 is placed on the container 242. Further, the guiding sleeve 250 provides for a sturdier connection between the actuator cap 240 and the aerosol container 242 because the wall 252 of the guiding sleeve 250 provides additional structural reinforcement to the connector 150. These and other advantages will be readily apparent to one skilled in the art upon reading the present disclosure.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

INDUSTRIAL APPLICABILITY

Attachment mechanisms are commonly used to securely attach dispensing devices to aerosol containers that may contain air fresheners, deodorants, insecticides, germicides, decongestants, perfumes, and the like. A mechanism for securely attaching an automatic actuation device to an aerosol container is presented. The mechanism may be installed in a typical actuator cap for use with ordinary aerosol containers, resulting in an improvement in utility of the aerosol container.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An attachment mechanism for a container, comprising:

a bracket having upper and lower portions, wherein an annular wall is disposed between the upper and lower portions;

a plurality of projections extending from the lower portion, wherein the projections are adapted to releasably engage an upper portion of a container;

a tab extending radially inwardly from the upper portion; and a connector having a prong and a flange extending upwardly from the prong, wherein a distal portion of the prong is spaced circumferentially from the connector, and wherein the prong is adapted to be secured within a slot defined between the tab and the annular wall.

2. The attachment mechanism of claim 1, wherein a locking element is disposed between the annular wall and a bottom end of the bracket.

3. The attachment mechanism of claim 2, wherein the projections extending from the lower portion extend from the locking element.

4. The attachment mechanism of claim 1, wherein a plurality of equidistantly spaced tabs extend from the upper portion.

5. The attachment mechanism of claim 1, wherein the prong is inclined relative to a transverse axis thereof.

6. The attachment mechanism of claim 1, wherein the connector includes a frangible rib for retaining the connector in a non-operable position on the bracket.

7. The attachment mechanism of claim 1, wherein the prong has a sickle-shaped profile that is adapted to fit within the slot.

8. A method of attaching a cap to a container, comprising:

providing a bracket having upper and lower portions, wherein an annular wall is disposed between the upper and lower portions;

providing a plurality of projections extending from the lower portion, wherein the projections are adapted to releasably engage an upper portion of a container;

providing a tab extending radially inwardly from the upper portion; and providing a connector having a prong and a frangible rib for retaining the connector in a non-operable position on the bracket, wherein a distal portion of the prong is spaced circumferentially from the connector, and wherein the prong is adapted to be secured within a slot defined between the tab and the annular wall.

9. The method of claim 8, wherein a locking element is disposed between the annular wall and a bottom end of the bracket.

10. The method of claim 9, wherein the projections extending from the lower portion extend from the locking element.

11. The method of claim 8, wherein a plurality of equidistantly spaced tabs extend from the upper portion.

12. The method of claim 8, wherein a plurality of prongs extend from the connector.

13. The method of claim 8, wherein the prong is inclined relative to a transverse axis thereof.

14. The method of claim 8, wherein the prong has a sickle-shaped profile that is adapted to fit within the slot.

15. An attachment mechanism for a container, comprising:

a bracket having upper and lower portions, wherein an annular wall is disposed between the upper and lower portions;

a plurality of projections extending from the lower portion, wherein the projections are adapted to releasably engage an upper portion of a container;

a tab extending radially inwardly from the upper portion; and a connector having a prong, wherein a distal portion of the prong is spaced circumferentially from the connector, and wherein the prong is adapted to be secured within a slot defined between the tab and the annular wall, wherein the connector further includes a frangible rib for retaining the connector in a non-operable position on the bracket.

16. The attachment mechanism of claim 15, wherein a locking element is disposed between the annular wall and a bottom end of the bracket.

17. The attachment mechanism of claim 16, wherein the projections extending from the lower portion extend from the locking element.

18. The attachment mechanism of claim 15, wherein a plurality of equidistantly spaced tabs extend from the upper portion.

19. The attachment mechanism of claim 15, wherein the prong is inclined relative to a transverse axis thereof.

20. The attachment mechanism of claim 15, a flange extends upwardly from the prong.

* * * * *